US009845581B2

(12) United States Patent
Behan et al.

(10) Patent No.: US 9,845,581 B2
(45) **Date of Patent: *Dec. 19, 2017**

(54) PLOW FOR USE WITH AUTOMOBILES AND OTHER VEHICLES

(71) Applicant: Nordic Auto Plow, LLC, West Chicago, IL (US)

(72) Inventors: Richard Anthony Behan, West Chicago, IL (US); Paulette Sanders Behan, West Chicago, IL (US)

(73) Assignee: Nordic Auto Plow, LLC, West Chicago, IL (US)

( * ) Notice: Subject to any disclaimer, the term of this patent is extended or adjusted under 35 U.S.C. 154(b) by 54 days.

This patent is subject to a terminal disclaimer.

(21) Appl. No.: 14/825,897

(22) Filed: Aug. 13, 2015

(65) Prior Publication Data

US 2016/0053451 A1 Feb. 25, 2016

Related U.S. Application Data

(63) Continuation-in-part of application No. 13/738,990, filed on Jan. 11, 2013, now abandoned, which is a continuation-in-part of application No. 13/273,445, filed on Oct. 14, 2011, now Pat. No. 9,169,617.

(51) Int. Cl.
*E01H 5/06* (2006.01)
*E01H 5/04* (2006.01)

(52) U.S. Cl.
CPC ..... *E01H 5/061* (2013.01); *E01H 5/04* (2013.01); *E01H 5/065* (2013.01); *E01H 5/066* (2013.01)

(58) Field of Classification Search
CPC ..... E02F 3/7627; E02F 3/815; E01H 5/06; E01H 5/061; E01H 5/04; E01H 5/065; E01H 5/066
USPC ..... 37/231, 267, 285, 263
See application file for complete search history.

(56) References Cited

U.S. PATENT DOCUMENTS

| | | | |
|---|---|---|---|
| 1,142,677 | A | 6/1915 | Darois |
| 1,195,271 | A | 8/1916 | Ruth |
| 1,805,933 | A | 5/1931 | Harold |
| 2,141,558 | A | 12/1938 | Richter |
| 2,188,805 | A | 1/1940 | Borgeson |
| 2,191,323 | A | 2/1940 | Richter |
| 2,347,963 | A | 5/1944 | O'Neill |
| 2,430,221 | A | 11/1947 | Frink et al. |
| 2,468,950 | A | 5/1949 | Wiedman |
| 2,575,091 | A | 11/1951 | Borgeson |
| 2,582,136 | A | 1/1952 | Koblas |
| 2,622,349 | A | 12/1952 | Carl |

(Continued)

*Primary Examiner* — Jamie L McGowan
(74) *Attorney, Agent, or Firm* — Vedder Price P.C.

(57) ABSTRACT

A personal use plow for pushing, but not limited to, snow and slush from one's driveway by most passenger automobiles and/or ATVs that is attached using a unique strapping and cog bracing system. The plow is made of injected molded structural foam plastic and comes in five (5) separate panels that can be easily assembled into a solid plow blade. This material is lightweight and allows for easy transportation, storage and use. When assembled, the plow can be used either in the front or back of the vehicle. The plow attaches to the vehicle by a special hook, designed as part of this patent, which attaches to the hood, trunk or luggage rack of the vehicle. All parts for the functionality of the plow are contained on the plow itself, so there are no brackets or hitches required to be attached to the bumpers of the vehicle.

10 Claims, 10 Drawing Sheets

(56) References Cited

U.S. PATENT DOCUMENTS

| | | | |
|---|---|---|---|
| 2,722,064 | A | 11/1955 | Jaffe et al. |
| 2,754,601 | A | 7/1956 | Meyer |
| 2,920,187 | A | 1/1960 | Barilla |
| 3,098,309 | A | 7/1963 | Koch |
| 3,316,665 | A | 5/1967 | Rinaldo |
| 3,349,507 | A | 10/1967 | Payne |
| 3,448,534 | A | 6/1969 | Pipes et al. |
| 3,608,216 | A | 9/1971 | Prescott |
| 3,760,883 | A | 9/1973 | Birk |
| 3,866,342 | A | 2/1975 | Cooper |
| 4,073,077 | A | 2/1978 | Essel et al. |
| 4,304,056 | A | 12/1981 | Watson et al. |
| 4,574,502 | A | 3/1986 | Blau |
| 4,754,562 | A | 7/1988 | McGarrah et al. |
| 4,833,799 | A | 5/1989 | Harte et al. |
| 4,873,775 | A | 10/1989 | Richey |
| 4,944,104 | A | 7/1990 | Kowalczyk |
| 4,962,598 | A | 10/1990 | Woolhiser et al. |
| 4,976,053 | A | 12/1990 | Caley |
| 5,036,608 | A | 8/1991 | Ciula |
| 5,111,603 | A | 5/1992 | Knowlton et al. |
| 5,125,174 | A | 6/1992 | Watson et al. |
| 5,129,170 | A | 7/1992 | Fusilli |
| 5,136,795 | A | 8/1992 | Rosenberg |
| 5,193,296 | A | 3/1993 | Reilley |
| 5,195,261 | A | 3/1993 | Vachon |
| 5,207,010 | A | 5/1993 | Grossman |
| 5,228,734 | A | 7/1993 | Pollastro |
| 5,251,390 | A | 10/1993 | Wong |
| 5,271,169 | A | 12/1993 | Konsztowicz |
| 5,509,219 | A | 4/1996 | Mecca |
| 5,511,328 | A | 4/1996 | Fingerer et al. |
| 5,531,036 | A | 7/1996 | Shinkle |
| 5,616,544 | A | 4/1997 | Kalota et al. |
| 5,676,412 | A | 10/1997 | Kahley |
| D391,271 | S | 2/1998 | Matisz et al. |
| 6,009,642 | A | 1/2000 | Nugent |
| 6,240,662 | B1 | 6/2001 | Borowiak |
| 6,299,381 | B1 | 10/2001 | Liebrecht, Jr. |
| 6,681,505 | B1 | 1/2004 | Wells |
| 6,964,121 | B2 | 11/2005 | Harris |
| 6,983,558 | B2 | 1/2006 | Haas |
| 7,237,814 | B2 | 7/2007 | Handzlik |
| 7,509,758 | B2 | 3/2009 | Nesseth |
| 7,685,748 | B1 | 3/2010 | Anderson |
| 7,730,643 | B2 | 6/2010 | Mishra et al. |
| 7,793,440 | B1 | 9/2010 | Ropog |
| 8,176,661 | B2 | 5/2012 | Brame |
| 8,291,622 | B2 | 10/2012 | Gappy |
| 8,381,421 | B2 | 2/2013 | Lhota et al. |
| 8,393,096 | B2 | 3/2013 | Thomas |
| 2007/0089327 | A1 | 4/2007 | Watson |
| 2009/0249657 | A1 | 10/2009 | Freeman |

PLOW FOR USE WITH AUTOMOBILES AND OTHER VEHICLES

RELATED APPLICATIONS

The present utility patent application is a continuation-in-part and claims priority from and the benefit of its parent, U.S. patent application Ser. No. 13/273,445, filed Oct. 14, 2011, titled PLOW FOR USE WITH AUTOMOBILE and U.S. patent application Ser. No. 13/738,990, filed Jan. 11, 2013, titled PLOW FOR USE WITH AUTOMOBILE AND OTHER VEHICLES which is a continuation-in-part and claims priority from and the benefit of its parent, U.S. patent application Ser. No. 13/273,445, the contents of which are hereby incorporated by reference in their entirety.

FIELD OF THE INVENTION

The present invention relates to a plow for use with an automobile to push or pull snow, sand, gravel and other such materials.

BACKGROUND OF THE INVENTION

This invention relates to a lightweight plow that can be attached to the front of a motor vehicle such as an automobile, small truck, all-terrain vehicle, small tractor or other similar motorized vehicle, for use in removing snow from a residential driveway. It may also be used for occasional moving of other materials such as sand or gravel. There are many commonly used methods of removing snow from residential driveways: snow shovels, snow blowers, and heavy hydraulically operated snow plows mounted on the front of trucks. The deficiencies of the snow shovel are that it requires heavy lifting and/or pushing of snow in back-breaking fashion in multiple, small quantities. Snow blowers can be quite expensive, require trips to the gas station for fuel, may have persistent starting problems, and may be inefficient due to wind conditions. Both shoveling and snow blowers require the user to be out in the cold elements and require them to be in relatively good health so as to avoid stress on their hearts. The snow plows attached to trucks require enormous investment in both the vehicle and the plow, the plows are usually made of steel which will rust over time, and require substantial storage space. Wheel weights are required on the truck to counterbalance the weight of the steel plow, and chains may be required to provide sufficient traction. The hydraulics used to operate the plows require substantial maintenance. Finally, the majority of homeowners do not have their own truck and snow plow, but must hire someone to clear their drive. This may result in the drive not being cleared as soon as the homeowner would prefer.

While not commonly used, arrangements have been disclosed in the past for attaching a plow to a passenger vehicle. Many such arrangements required welding or bolting plow support structures to the frame or other metal structures, such as metal bumpers, of the automobile. The following patents disclose arrangements for propelling plows by an automobile which do not require the bolting, clamping or welding of metal structures to the automobile:

U.S. Pat. No. 3,448,534, Jun. 10, 1969, Pipes et al.
U.S. Pat. No. 4,944,104, Jul. 31, 1990, Kowalczyk
U.S. Pat. No. 5,136,795, Aug. 11, 1992, Rosenberg
U.S. Pat. No. 5,207,010, May 4, 1993 Grossman
U.S. Pat. No. 6,518,544, Feb. 11, 2003, Matisz et al.

The Pipes et al. patent sets forth a snowplow for a vehicle which attaches to a vehicle by a pair of universal bumper hitch assemblies 64, each of which includes a rod 66 extending from the bumper to the rear of the mold bars 16. Thus, the snowplow arrangement of the Pipes et al. patent is not usable with current automobiles that do not have bumpers. Similarly, the snow plow assembly of the Rosenberg patent is attached to the bumper of an automobile. The Kowalczyk patent reveals a snowplow blade which is supported on the vertical portions of two L-shaped members, with the horizontal portions being attached to the automobile by suction cups. The Grossman patent sets forth a snowplow which is formed by folding sheets of planar material, and attaching the formed snowplow to an automobile with straps, Velcro strips, screw, bolts, adhesives or any other suitable material. The Matisz et al. patent shows a snowplow consisting of two blade wing sections, each of which has an integrally formed bumper column which engages the bumper of a vehicle. Each of the two blade wing sections are secured to the vehicle by a strap.

BRIEF SUMMARY OF THE INVENTION

It is an object of this invention to provide a plow which is readily attached to an automobile without requiring any modification of the automobile and without requiring the use of tools. It is another object of this invention to provide a plow which is light weight, such that it may be readily positioned for use on a vehicle and removed therefrom for storage. It is still another object of this invention to provide a plow having a blade which is provided in segments which may be readily attached to each other. A still further object of this invention is to provide a plow which includes readily assembled parts which make the plow adaptable for use on a variety of vehicles and for aligning the plow to move the plowed material to the right, left or directly ahead of the direction of movement of the vehicle.

In accordance with this invention, a light weight plow is readily assembled from a plurality of light weight components. The blade is formed of one or more middle sections and a pair of end sections which are secured to each other. The sides of the middle sections and the inner side of the end sections are formed to provide an interlocking arrangement with each other. The lower edges of the blades are rounded to reduce the friction with the surface being plowed, and thereby reduce the power required to push the blade. At least two cog plates are provided on the back of an assembled blade, with a portion of each cog plate engaging the vehicle, such that the blade may be pushed by the vehicle. One of the cog plates may be provided with an extender, such that the blade will extend at an angle with respect to the end of the vehicle engaged by the cog plates. At least a pair of straps are secured between the blade and the vehicle, to cause the blade to move with the vehicle, when the vehicle is moving in the opposite direction to that which the plow is being pushed. The plow may be secured to either the front or the back of an automobile for plowing use. Additional mounting devices may be provided to adapt the light weight plow for use with motorized vehicles other than automobiles, such as small tractors, riding lawn mowers, all-terrain vehicles and zero-turn mowers, to name a few.

DETAILED DESCRIPTION OF THE INVENTION

Figure 1:
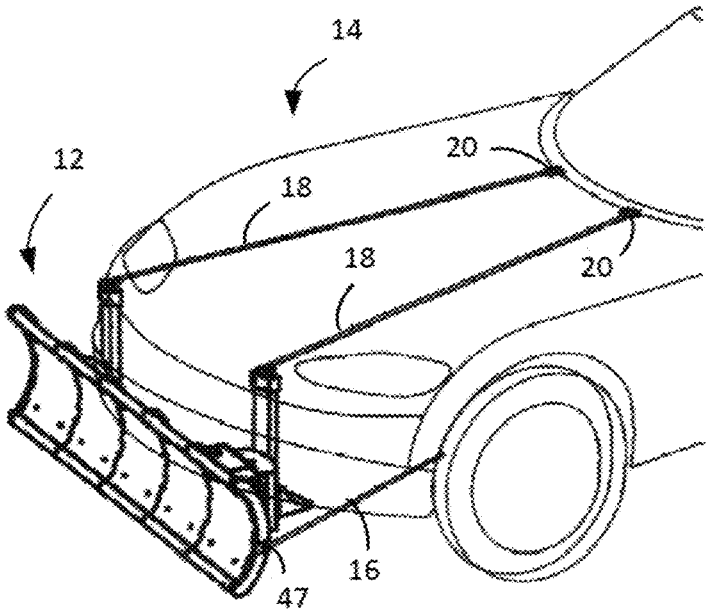
FIG. 1 is a perspective view of a plow in accordance with this invention, mounted for use on the front of an automobile.

Referring to FIG. 1, a plow 12 in accordance with this invention is positioned at the front of an automobile 14, for plowing material in front of the automobile. Portions of the plow engage the lower front trim 16 of the automobile, and straps 18 extend from the plow to clips 20 engaging the rear edge of the automobile hood.

Figure 2:
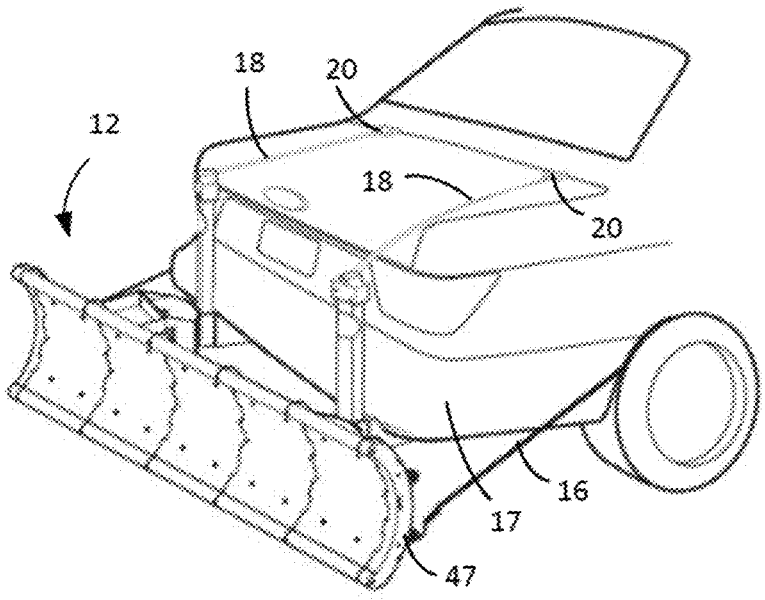
FIG. 2 is a perspective view of a plow in accordance with this invention, mounted for use on the rear of an automobile.

Similarly, referring to FIG. 2, a plow 12 in accordance with this invention is positioned at the back of an automobile 14, for plowing material behind the automobile. Portions of the plow engage the lower back trim 17 of the automobile, and straps 18 extend from the plow to clips 20 engaging the rear edge of the automobile trunk lid.

Figure 3:
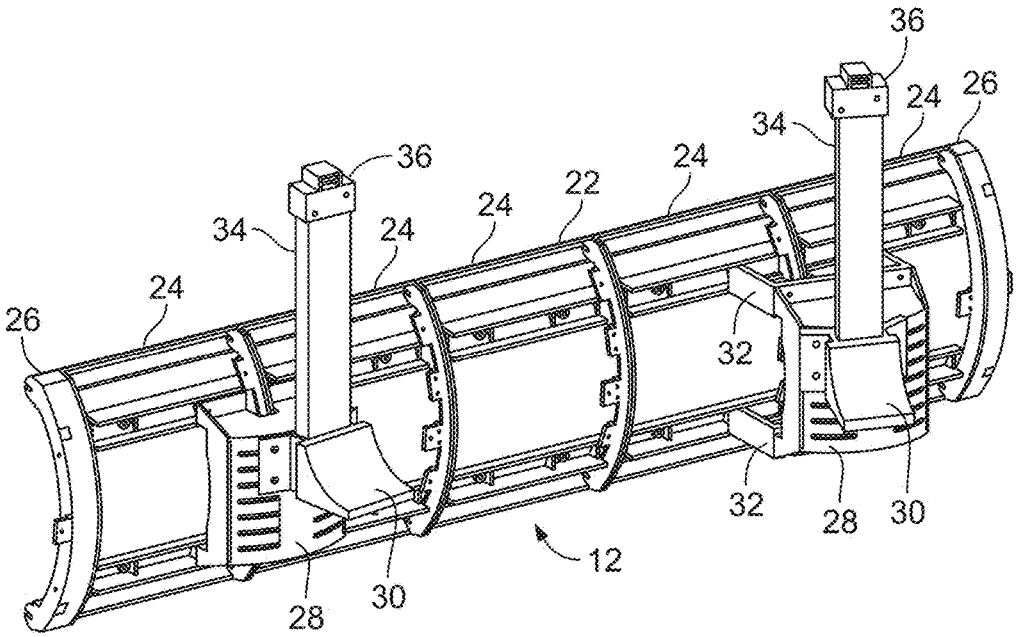
FIG. 3 is a perspective rear view of a plow in accordance with this invention.
Figure 4:
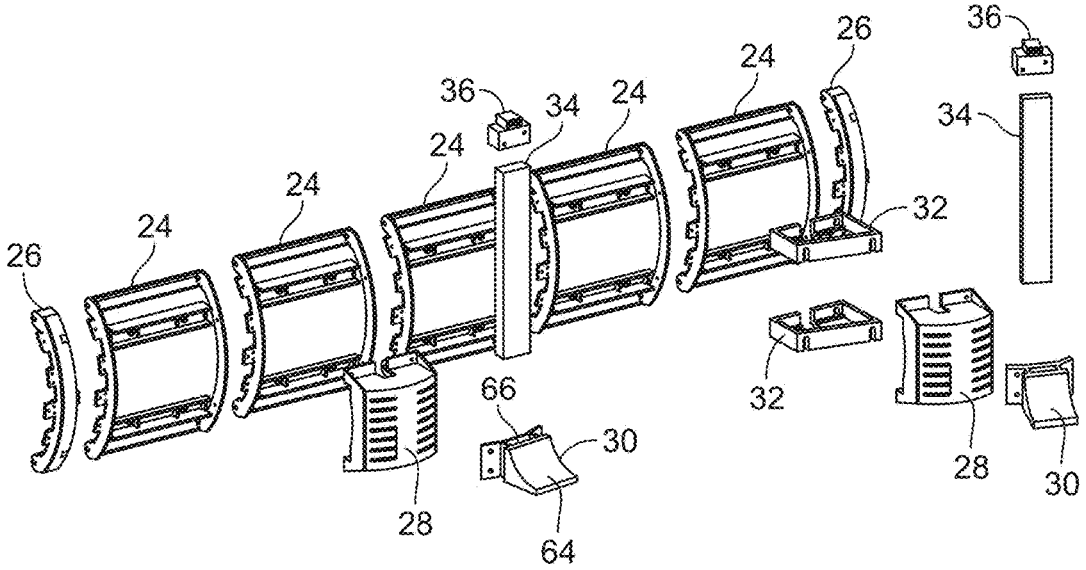
FIG. 4 is an exploded perspective rear view of a plow in accordance with this invention.

Referring to FIG. 3, a plow 12 in accordance with the invention is readily assembled from a plurality of components. The snow plow blade 22 is shown to be an assembly of five identical blade sections 24. However, the snow plow blade may be formed of more or less identical blade sections 24, depending on the width of the automobile or other vehicle, and the width of the area to be plowed. Secured to the back of the blade 22 are two identical cog plates 28, to each of which is secured a cog 30. Such that the blade 22 may be tilted to the right or left with respect to the vehicle to which it is attached, a pair of cog extenders 32 may be placed between the blade 22 and a cog plate 28. Secured in each of the cogs is a stud 34, which extends upward and is provided with a stud cap 36.

Each of the components of the snow plow 12 in accordance with this invention will now be described by making reference to FIGS. 4, 5 through 11*a* and 11*b*.

Figure 5A:
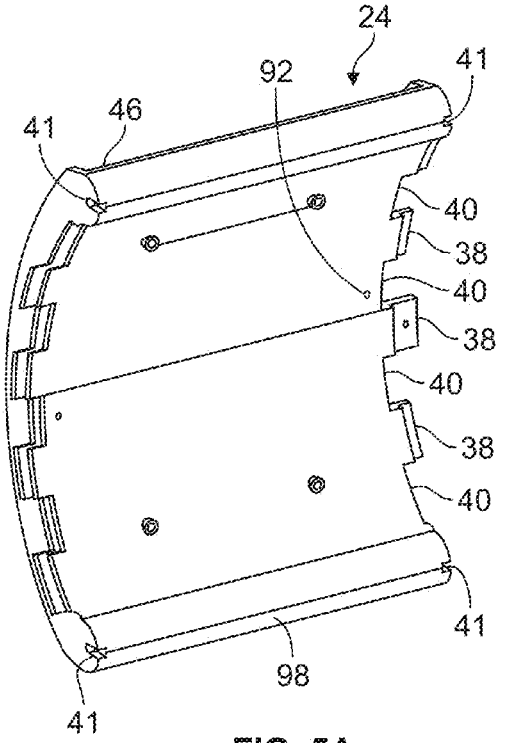
FIGS. 5*a* and 5*b* are, respectively, front and rear perspective views of a blade section of a plow in accordance with this invention.
Figure 5B:
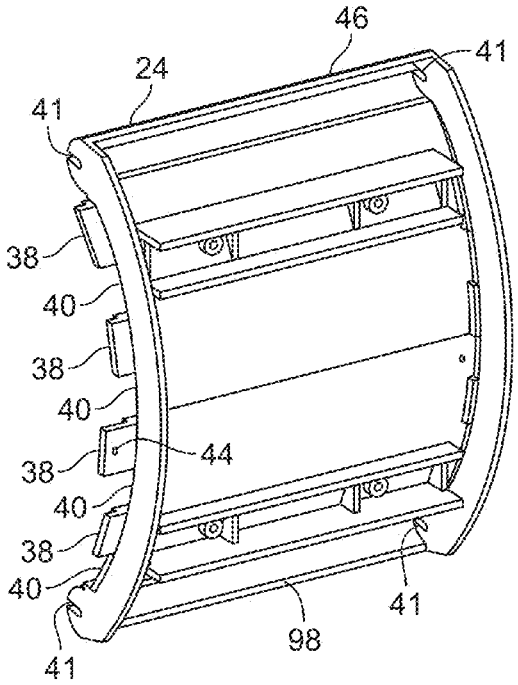

Front and rear views of a blade section 24 are shown in FIGS. 5*a* and 5*b*, respectively. Each side of a blade section 24 is provided with alternating tabs 38 and spaces 40. The tabs 38 and the spaces 40 form an interlocking connection between adjacent blade sections. Holes 42 are provided adjacent the spaces 40 and holes 44 in the tabs 38 for receiving screws to secure adjacent blade sections to each other. Holes 41 are provided for receiving fastening bolts to secure adjacent blade sections to each other, however, other fastening members can be used.

The blade sections 24, as well as most of the other components of the snow plow 12, are formed of high-impact ABS plastic of sufficient thickness to provide for strength and durability when plowing, even under the harsh conditions of winter. Other lightweight materials of sufficient strength and durability could be used, such as injection-molded structural plastic, and other plastics. When bolted together, the combined sections create a strong yet flexible blade in excess of six feet in length. This flexibility is provided by the material forming the blade sections 24 and by the multiple sections. The flexibility allows for the stress and weight of the snow to be distributed throughout the several blade sections, rather than just in the area directly affected.

The top 46 and the bottom 48 of each of the blade sections 24 is provided with a rounded reinforced edge that enhances the durability of the snow plow as it pushes snow over a concrete, gravel or asphalt surface. The rounded edge essentially eliminates the chance of the blade engaging and attempting to push a raised section of the paved surface, or a rock or other object secured to the surface by ice. The top 48 and bottom 48 of a blade section may be rotated, so as to replace a worn bottom 48 with an unworn top 46. The rounded edges, along with the flexibility of the blade, will keep the blade from getting stuck against cracks or solid ice, and eliminate the need for height skids usually provided on at lower edge of snow plow blades. In addition, the blade is designed so that the top and bottom are the same, thus making it reversible, and thereby doubling the life of the snow plow.

Figure 6B:
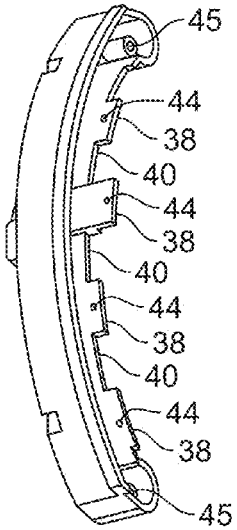
FIGS. 6*a* and 6*b* are, respectively, outer and inner perspective views of an end cap for the blade sections of a plow in accordance with this invention.
Figure 6A:
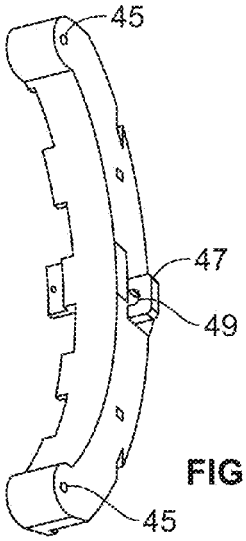

Referring to FIGS. 6*a* and 6*b*, an end cap 28 is shown. An end cap is secured to the outer side of the last blade section 24 on each end of the plow. Again, each of the end caps 26 is secured to the adjacent blade section, being provided with tabs 38 and spaces 40. The tabs 38 and the spaces 40 form an interlocking connection between the end cap 26 and the adjacent blade section 24. Again, holes 42 are provided adjacent the spaces 40 and holes 44 in the tabs 38 for receiving fastening members such as screws to secure adjacent blade sections to each other. Holes 45 are provided for receiving fastening members such as screws to secure an end cap 28 to a blade section 24 at the outer ends of the blade 22. A tab 47 having a hole 49 therein is provided for accommodating the end of a strap, the other end of which strap is secured to the automobile to hold the plow against the automobile when the direction of movement of the automobile is reversed from the plowing direction.

Figure 7A:
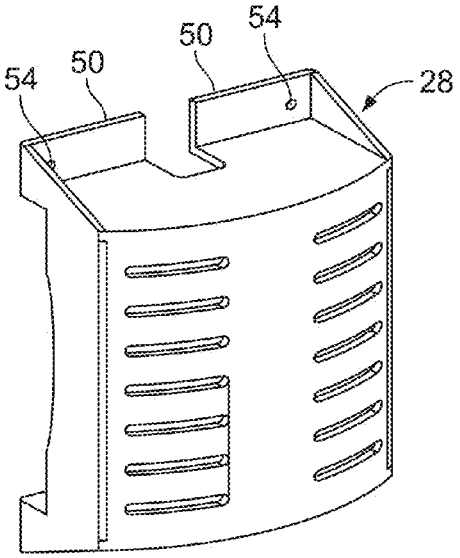
FIGS. 7*a* and 7*b* are, respectively, front and rear perspective views of a cog plate of a plow in accordance with this invention.
Figure 7B:
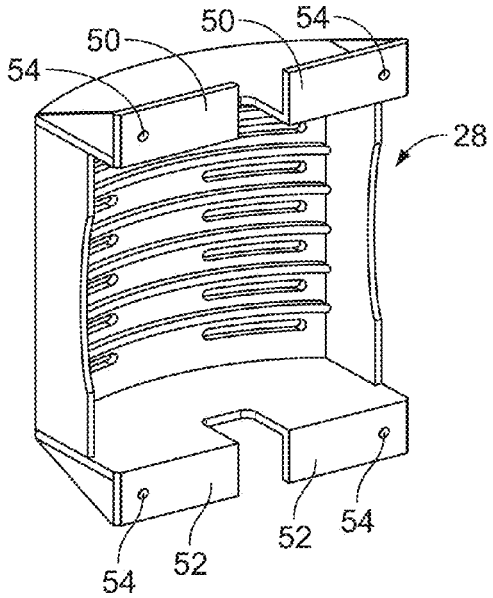

Referring to FIGS. 7*a* and 7*b*, the front and back of a cog plate 28 are shown. Flanges 50 and 52 are provided at the back of the cog plates to be secured to the back of blade sections 24. Holes 54 are provided in the flanges 50 and 52 to receive fastening members such as bolts, or locking pins to secure the cog plates 28 to the back of blade sections 24.

Figure 8A:
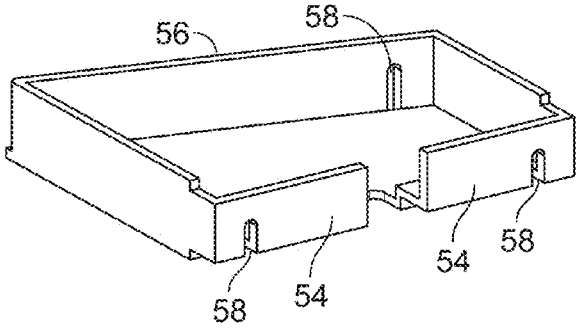
FIGS. 8*a* and 8*b* are, respectively, top and bottom perspective views of a cog extender of a plow in accordance with this invention.
Figure 8B:
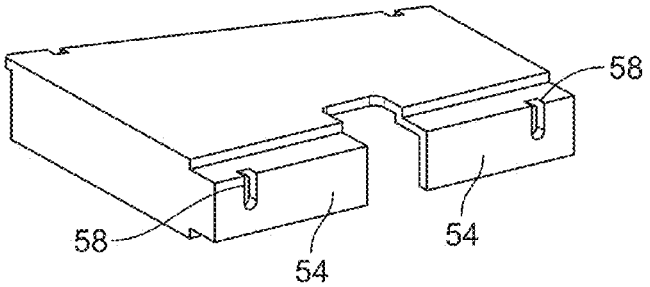

Referring to FIGS. 8*a* and 8*b*, top and bottom views, respectively, of a cog plate extender 32 are shown. A cog plate extender 32 has a front wall 54 and a back wall 56 which are each provided with slots 58 for receiving fastening members such as bolts, or locking pins to secure the cog plates extender 32 to the back of blade sections 24 and to a cog plate 28.

Figure 9A:
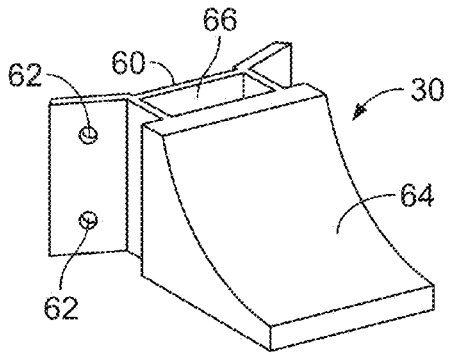
FIGS. 9*a* and 9*b* are, respectively, rear and bottom perspective views of a cog of a plow in accordance with this invention.
Figure 9B:
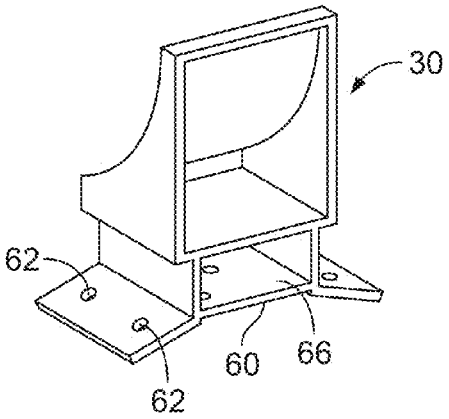

Referring to FIGS. 9*a* and 9*b*, rear and bottom perspective views of a cog 30 which is attached to a cog plate 28 is shown. A cog 30 is provided with a flange 60 having holes 82 therein for receiving a fastening member such as a bolt, or locking pin to secure the cog 30 to a cog plate 28. The cog 30 also has a curved surface 64 which is provided for engagement with the lower trim of an automobile, or a surface of another type of a vehicle, to propel the snow plow 12, when the vehicle is moved to cause the plow 12 to move snow or other material. The cog 30 is also provided with a rectangular slot or opening 66, for receiving a stud 34, as shown in FIGS. 1, 2, and 3, which extends upwardly from the plow 12.

Figure 10A:
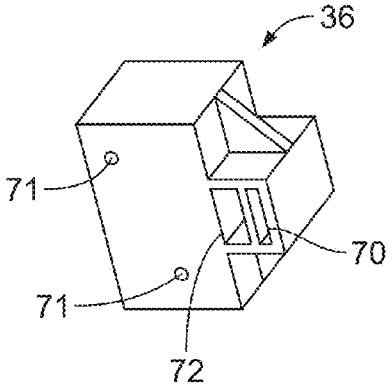
FIGS. 10*a* and 10*b* are, respectively, rear and bottom perspective views of a stud cap of a plow in accordance with this invention.
Figure 10B:
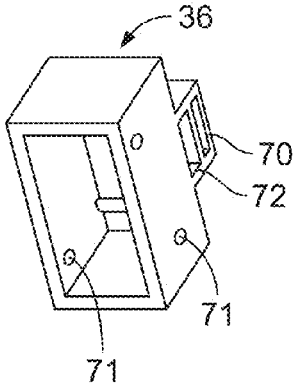
Figure 11A:
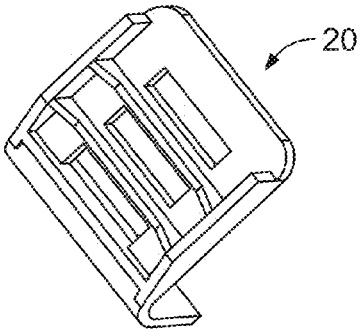
FIGS. 11*a* and 11*b* are, respectively, top and bottom perspective views of a hood clip of a plow in accordance with this invention.
Figure 11B:
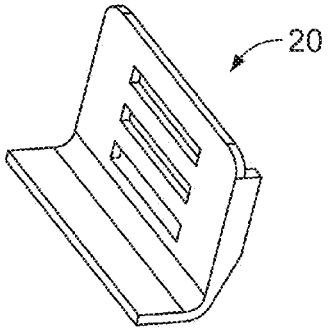
Figure 12C:
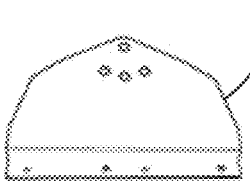
FIGS. 12*a*-12*k* show the adaptive component utilized to mount the plow of this invention to an all-terrain vehicle or a quad.
Figure 12D:
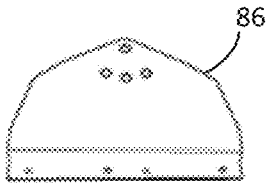
Figure 12A:
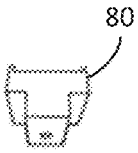
Figure 12B:
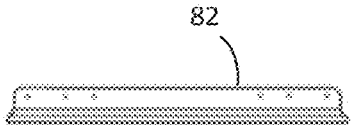
Figure 12E:
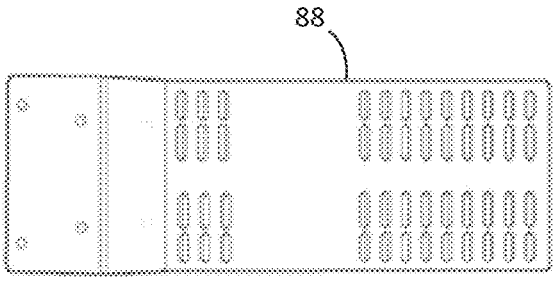
Figure 12F:
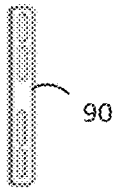
Figure 12G:
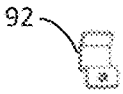
Figure 12H:
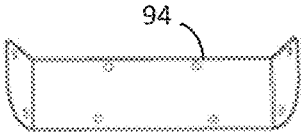
Figure 12I:
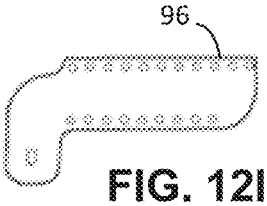
Figure 12K:
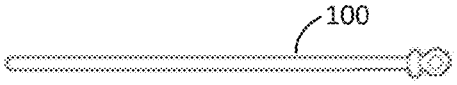
Figure 12J:
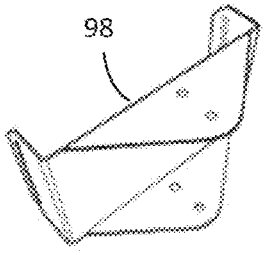

Referring to FIGS. 10*a* and 10*b*, rear and bottom views, respectively, of a stud cap 36 which is secured to the top of a stud 34 are shown. The top of the stud cap 36 is provided with slots 70 and 72 for securing one end of a strap 18, the other end of which is secured to a strap clip 20 and shown in FIGS. 10*a* and 10*b*. Holes 71 are provided to fasten the stud cap 38 to the stud 34 using screws.

The assembly of the plow is simple, such that anyone familiar with the use of a screw-driver and wrench can put it together in approximately ten minutes. In the preferred assembly, two bolts attach each of the blade sections and end caps, four bolts attach each cog plate to two adjacent blade sections, or to two cog extenders, and four bolts attach the cog to two adjacent cog plates.

In the preferred embodiment, a stud 34 is formed of typical 2×4 lumber cut to an appropriate length to extend, for instance, above the hood of an automobile with which the plow is to be used. The 2×4 may be wrapped with a material, such as neoprene, to provide a cushion where it comes into engagement with the automobile. The neoprene cover slip may be attached to the stud with hook and loop material. Wood screws may be used to attach a stud 34 to a cog 30 and a stud cap 36. In a preferred assembly, bolts and wing nuts are used to secure a cog to a cog plate. The use of the wing nuts makes it easier to adjust the vertical position of the cog 30 on the cog plate 28, depending on the height of the surface of the vehicle against which the curved surface 84 will bear with respect to the bottom of the blade sections 24. In addition, the cogs 30 can be adjusted to the right or left of center to account for the various curves of the vehicle surface to be engaged by the curved surface 64 of the cog 30. This allows for a flush fit of the stud 34 to the engaging surface of the vehicle, which will keep damage and/or scratches from occurring. In addition to this adjustment, we have included a neoprene cover slip that will attach to the stud with hook and loop material to provide additional protection to the bumper.

The key to the functionality of the blade is the stud and cog assembly. A quick measurement of the height of the bumper or other portion of the vehicle which engages the cog from the ground is made and the cog is tightened into an appropriate slot of the cog plate. The studs 34 are preferably cut to a length that allows for the stud cap to come even with the height of the hood or trunk. A typical passenger car requires a 20"-24" length, while a sports utility vehicle or pickup may be 30"-36" or higher. If the user of the plow of this invention has both types of vehicles, two sets of studs will provide for use of the plow on either vehicle. The cog extender plate can be attached to either the right or left side of the plow, depending on which direction from the vehicle you want the plowed material to be displaced. The cog plate extenders 32 can be moved from either side of the blade easily and quickly.

Once the blade is assembled and the location of the cogs 30 and the height of the studs 34 are determined, it will take very little time to complete the attachment to the vehicle for use, regardless if attaching it to the front or back of the vehicle. You begin by leaning the snow plow 12 against the engaging surface of the vehicle. A strap, formed of a material such as nylon, is run through the slots 70 and 72 in the stud cap 38, with the other end threaded through the strap clip 20, which engages the top edge of the hood or trunk. The clip 20 is made of, or coated with, a material that will not scratch the vehicle, yet is strong enough to keep the strap in place. The strap is pulled tight, but not over tightened. When the car is in motion, the weight of the snow and force of the vehicle makes the top of the blade sections, and therefore the top of the studs 34, lean forward and away from the vehicle. The strap keeps the stud securely against the bumper thus keeping the snow plow blade upright. In addition, the cog 30 will provide additional support to the stud 34 as it engages the vehicle's surface. The combination of the strap 8 and engagement of the cog 30 against the underside of the bumper distributes the stress of the plow while it's pushing snow or other material.

To keep the snow plow 12 attached to the vehicle when going in the opposite direction, a resilient strap or cord, such as a bungee cord is secured to an end cap at hole and the other end to a suitable structure in the wheel well of the vehicle. This allows for the vehicle to go down the driveway pushing snow, return up the driveway, and then change lanes to continue the snow removal. When the task is complete, one may simply detach the hook clips from the vehicle and store the plow in a suitable location. When the snow plow 12 will not be used for an extended period, such as at the end of winter, it may be easily disassembled and put into a box or bag for easy storage.

Figure 13:
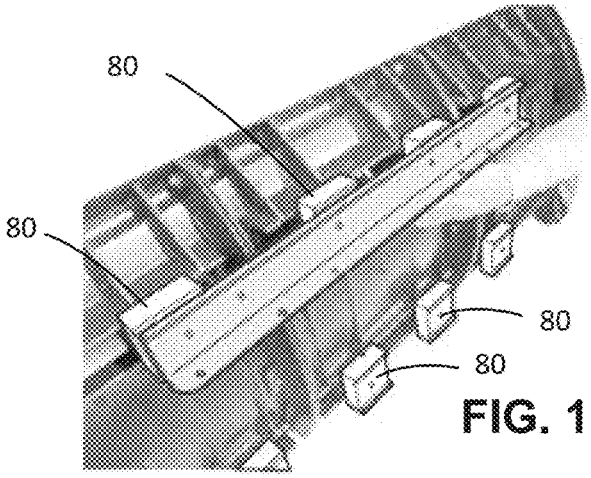
FIG. 13 shows a partial assembly of the adaptive components shown in FIGS. 12*a* and 12*b* to the plow of this invention.
Figure 14:
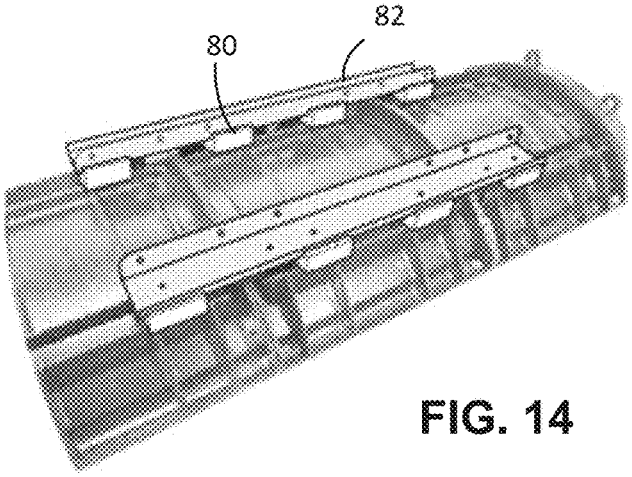
FIG. 14 also shows a partial assembly of the adaptive components shown in FIGS. 12*a* and 12*b* to the plow of this invention.
Figure 15:
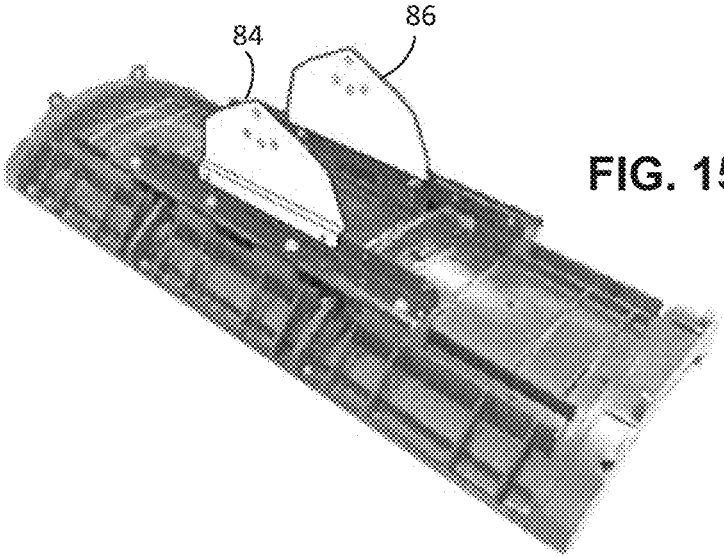
FIG. 15 shows a partial assembly of the adaptive components shown in FIGS. 12*a*-12*d* to the plow of this invention.
Figure 16:
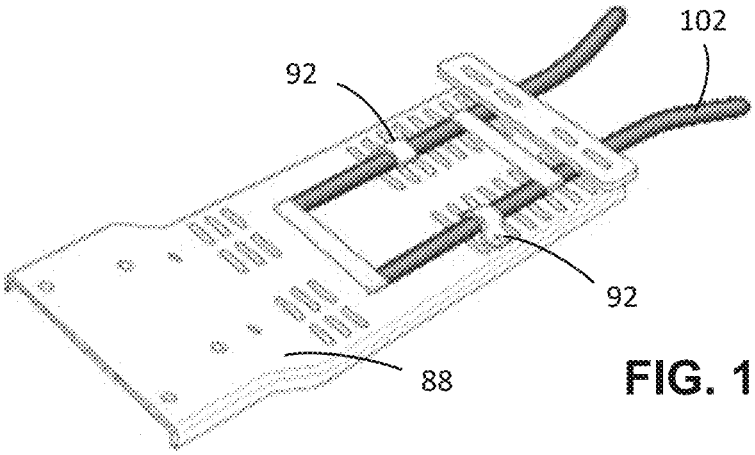
FIG. 16 shows the partial assembly of the adaptive components shown in FIGS. 12*e*-12*g* to the frame of an all-terrain vehicle.

While the plow of this invention is most readily used with an automobile, or other vehicles having similar front and back configurations, mounting arrangements can be provided whereby the plow may be used with other motorized vehicles. Such mounting arrangements include adaptive components secured to the plow and adaptive components secured to the motorized vehicle. Referring to FIGS. 12*a*-12*k*, adapter assembly parts utilized to mount the plow of this invention to an all-terrain vehicle or a quad are shown. The components include blocks 80, blade channels 82, top pivot plate 84, bottom pivot plate 86, which are attached to the back of the plow, and belly plate 88, clamp plate 90, clamp brackets 92, belly u-bracket 94, boot plates 98, pivot bracket 98, and axle 100, which are attached to the all-terrain vehicle. Referring to FIG. 13, the blocks 80 are secured to the back of the plow, and as shown in FIG. 14, the blade channels 82 are secured to the blocks. Pivot plates 84 and 86 are each secured to a blade channel as shown in FIG. 15.

Figure 17:
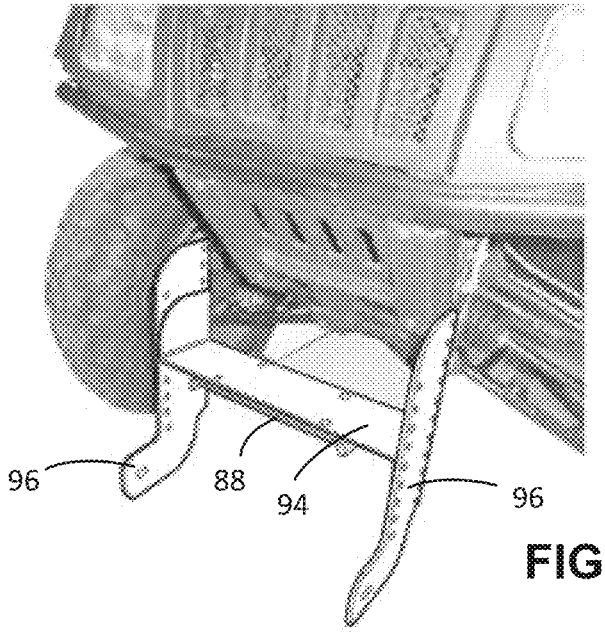
FIG. 17 shows the partial assembly of the adaptive components shown in FIGS. 12*h* and 12*i;*
Figure 18:
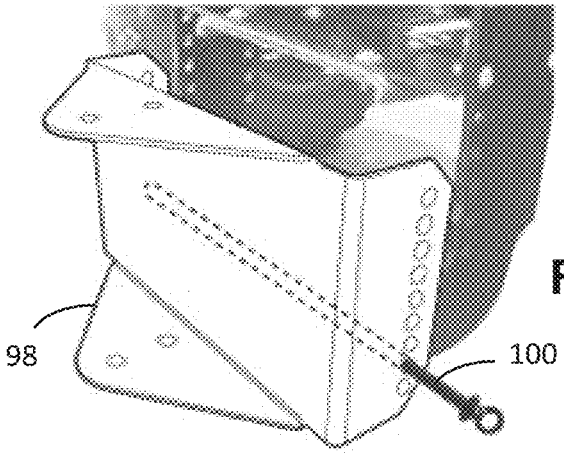
FIG. 18 shows the assembly of a pivot bracket to the partial assembly shown in FIG. 17.
Figure 19A:
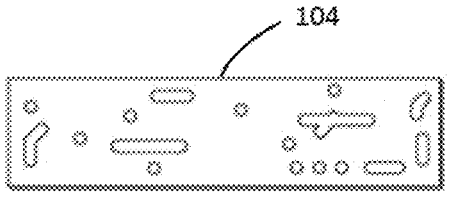
FIGS. 19*a*-19*d* show the adaptive component utilized to mount the plow of this invention to a riding lawn mower.
Figure 19B:
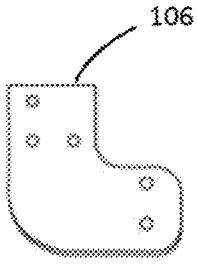
Figure 19C:
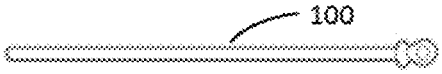

FIG. 18, shows the securing of the belly plate 88 to the all-terrain vehicle frame 102, by clamping the frame 102 between the belly plate 88 and the clamp plate 80 and the clamp brackets 92. The belly u-bracket 94 is secured to the belly plate 88, and the boot plates 96 to the belly u-bracket as shown in FIG. 17. The pivot bracket 98 is secured to the boot plates 96 by axle 100 as shown in FIG. 18. To attach the plow to the all-terrain vehicle, the pivot bracket 98 is secured to the top pivot plate 84 and the bottom pivot plate 86 by a pair of fasteners which pass through mating holes in the pivot plates 84 and 88 and the pivot bracket 98. One of the fasteners may be a bolt around which the pivot plates 84 and 88 may pivot with respect to the pivot bracket 98, and a quick-release pin which may be positioned in different mating holes in the pivot plates 84 and 88 and the pivot bracket 98, to position the plow at different angles with respect to the frame of the all-terrain vehicle.

Similarly, mounting arrangements may include adaptive components secured to the plow and adaptive components secured to other types of motorized vehicles. For instance, the plow of this invention may be attached to a typical riding lawn mower. To mount the plow of this invention on a riding lawn mower, the same adapter assembly parts shown in FIG. 12 which are attached to the back of the plow, include blocks 50, blade channels 82, top pivot plate 84, bottom pivot plate 88, are utilized. FIGS. 19*a*-19*d*, show the adapter assembly parts which are secured to the riding mower. The parts, mower arms 104, boot plates 106, are similar to parts used in mounting the plow to the all-terrain vehicle, and pivot bracket 98 and axle 100 are identical to those used in mounting the plow to the all-terrain vehicle.

Figure 20:
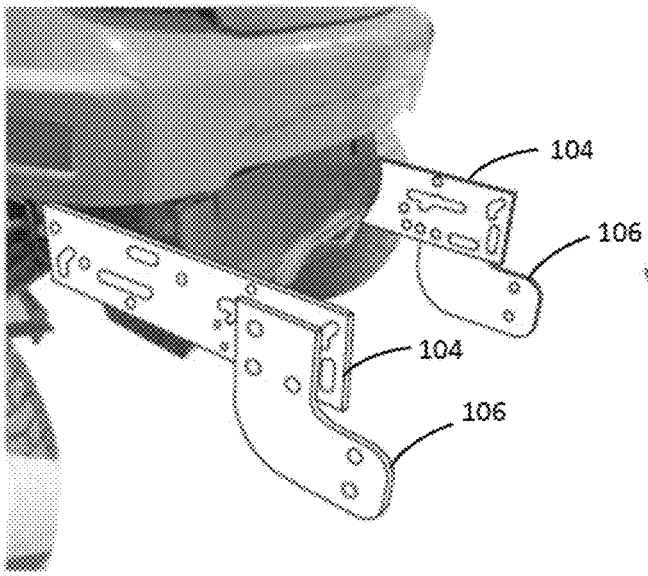
FIG. 20 shows the adaptive components of FIGS. 19*a* and 19*b* secured to a riding lawn mower.
Figure 19D:
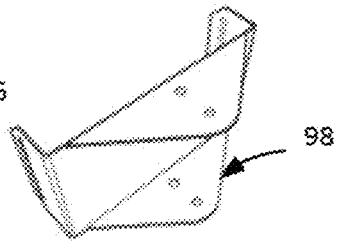

As shown in FIG. 20, the mower arms 104 are secured to the frame of the riding lawn mower, and the boot plates 106 are secured to the mower arms. A pivot bracket 98 is secured to the boot plates 106 in a similar manner to that shown in FIG. 18.

The concepts shown herein are very flexible and can be adapted to a wide variety of vehicles (motorized or not) for the removal of snow or other debris over a horizontal surface. For example, the inventor contemplates the use of a V-shaped blade, also made of multiple segments and endcaps to be attached to any known motorized garden equipment and even, for example, an action wheelchair.

In yet another embodiment, the blade curving in the direction of the debris to be moved can simply be attached on its ends and reversed inwardly. A vehicle used, for example, to treat a grass surface may raise rocks as it moves. By using lateral plates attached to the end of the blade curved inwards, the rocks will be collected by the blade, then collected between the blade and the back end of the motorized vehicle pulling the device.

Figure 21:
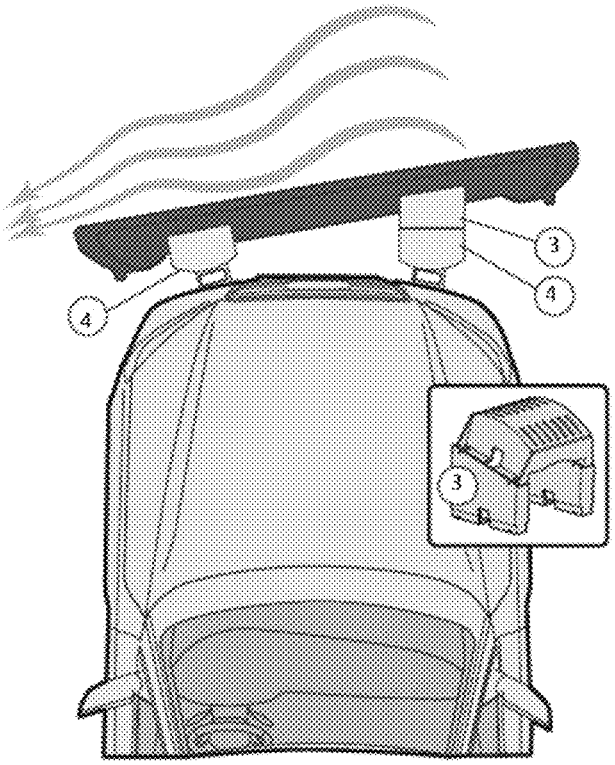
FIG. 21 is a top view of the plow used with a cog plate extender located on the right side of the vehicle to push debris to the right of the vehicle.
Figure 22:
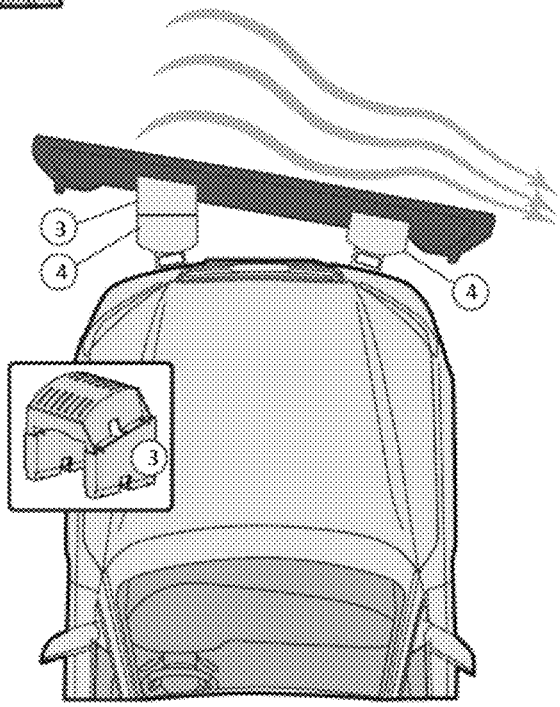
FIG. 22 is a top view of the plow used with a cog plate extender located on the left side of the vehicle to push debris to the left of the vehicle.

FIG. 21 is a top view of the plow used with a cog plate extender located on the right side of the vehicle to push debris to the right of the vehicle. As explained above, in one embodiment, a cog extender 3 can be used on only one of the two sides of the blade to create an angle in the debris collection area which, in turn, will push the debris laterally either to the right or the left as shown by the wavy arrows. FIG. 22 shows the use of the extender to the left instead of the right. Shown as number 4 on these figures are the cogs themselves.

While a preferred embodiment of the plow of this invention has been shown, it should be apparent to those skilled in the art that what has been shown and described is considered at present to be a preferred embodiment of the plow of this invention. While mounting the plow of this invention on motor vehicles other than automobiles, other mounting arrangements are contemplated by this invention. In accordance with the Patent Statutes, changes may be made in the plow of this invention without actually departing from the true spirit and scope of this invention. The appended claims are intended to cover all such changes and modifications which fall within the true spirit and scope of this invention.

What is claimed is:

1. A plow for pushing or pulling material while said plow is attached to a motor vehicle comprising the following components:

two or more blade sections forming a blade with a back, where each of the blade sections includes a top edge and a bottom edge and having sides with spaced tabs along the entire section between the top and bottom edges, the spaced tabs positioned to mate with the spaced tabs of an adjoining blade section, forming an interlocking connection between blade sections wherein the tabs are part of the blade and form a continuous blade, at least a plate and extender secured to the back of the blade, at least a cog secured to the plate for engaging a surface of the motor vehicle, at least a stud with a strap securing a portion to the cog, and a first pair of straps having one end secured to the stud and the other end secured to the motor vehicle.

2. The plow of claim 1, wherein the top edge and the bottom edge have an identical rounded configuration.

3. The plow of claim 1, wherein the plow further comprises at least a blade end cap, with spaced tabs to mate to an adjoining blade section.

4. The plow of claim 1, wherein the stud includes a side strap attachment for securing a second pair of straps between the blade end cap and the motor vehicle.

5. The plow of claim 1, wherein the motor vehicle is an automobile.

6. A plow for pushing or pulling material while said plow is attached to a motor vehicle comprising the following components: a blade section made of injected molded material having a back, a top edge and a bottom edge, wherein the blade section is secured to the vehicle using at least a plat pith an extender secured to the back of the blade section and a vertical stud with an end for securing a strap to the vehicle, wherein the blade section includes a side with a spaced tab along the entire section between the top and bottom edges, the spaced tabs positioned to mate with the spaced tabs of an adjoining blade section forming an interlocking connection between multiple blade sections, and wherein the tabs are part of the blade and form a continuous blade.

7. A plow for pushing or pulling material while said plow is attached to a motor vehicle comprising the following components: a blade section made of injected molded material having a back, a top edge and a bottom edge, wherein the blade section is secured to the vehicle using at least a plate with an extender secured to the back of the blade section and a vertical stud with an end for securing a strap to the vehicle, wherein the top and bottom edges of the blade section are identical in shape to allow for use of either the top edge or the bottom edge as the portion of the blade section adjacent to the ground as the vehicle moves to plow, wherein the top edge is a rounded reinforced edge also of injected molded material integral to the blade section, and the bottom edge is also a rounded reinforced edge also of injected molded material integral to the blade section, wherein the blade section includes a side with a spaced tab along the entire section between the top and bottom edges, the spaced tabs positioned to mate with the spaced tabs of an adjoining blade section forming an interlocking connection between multiple blade sections, and wherein the tabs are part of the blade and form a continuous blade.

8. The plow of claim 7, wherein the top edge is rounded.

9. The plow of claim 7, wherein the bottom edge is rounded.

10. The plow of claim 7, wherein the motor vehicle is an automobile.

* * * * *